United States Patent [19]

Brygider

[11] Patent Number: 4,547,924

[45] Date of Patent: Oct. 22, 1985

[54] GUN CLEANING IMPLEMENT

[76] Inventor: Sanford L. Brygider, 1775-C Wilwat Dr., Norcross, Ga. 30093

[21] Appl. No.: 510,667

[22] Filed: Jul. 5, 1983

[51] Int. Cl.[4] ..... F41C 31/02

[52] U.S. Cl. ..... 15/104.16; 15/211; 42/1 BC

[58] Field of Search ..... 15/104.16, 104.165, 15/104.2, 211; 42/1 BC

[56] References Cited

U.S. PATENT DOCUMENTS

| | | | |
|---|---|---|---|
| 1,495,008 | 5/1924 | Feagin | 15/104.16 X |
| 1,526,177 | 2/1925 | Olberding | 15/104.16 |
| 2,805,434 | 9/1957 | Hopkins | 15/104.16 |
| 3,814,525 | 6/1974 | Spencer | 15/104.165 X |

FOREIGN PATENT DOCUMENTS

| | | | |
|---|---|---|---|
| 618786 | 8/1980 | Switzerland | 42/1 BC |
| 740067 | 11/1955 | United Kingdom | 15/104.16 |

*Primary Examiner*—Chris K. Moore
*Attorney, Agent, or Firm*—Jones & Askew

[57] ABSTRACT

A gun cleaning implement comprising a cleaning swab and a cleaning tip, the cleaning tip having a threaded portion for retainably receiving a first cleaning swab thereon. The cleaning tip also has a smooth portion for receiving a second cleaning swab. The second swab may be removed from the tip after one pass through the bore of a gun, leaving the first swab retained on the tip for a second pass through the bore.

4 Claims, 5 Drawing Figures

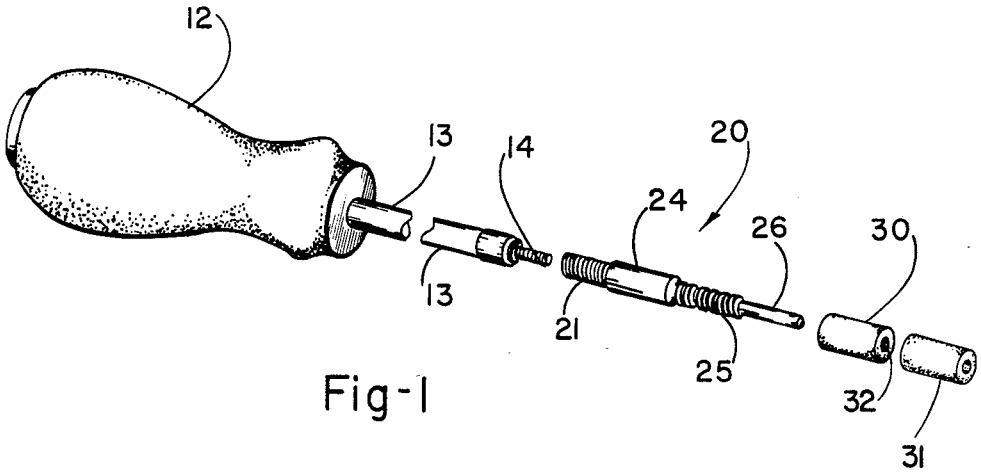
Fig-1
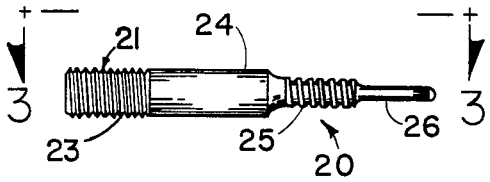
Fig-2
Fig. 3
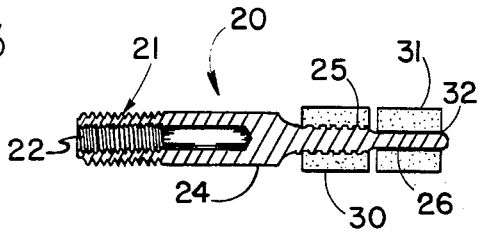
Fig.5
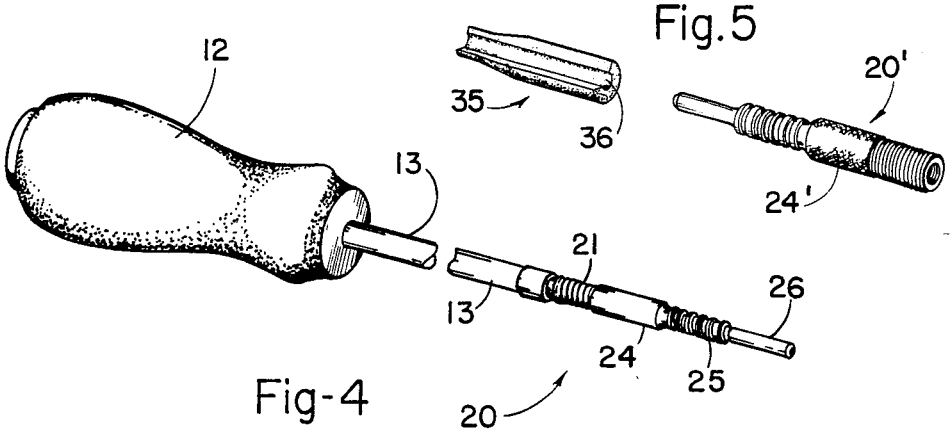
Fig-4

GUN CLEANING IMPLEMENT

TECHNICAL FIELD

The present invention relates to maintaining a firearm, and more particularly, relates to an improved gun cleaning implement.

BACKGROUND OF THE INVENTION

A firearm is typically cleaned by use of a gun cleaning rod. A conventional gun cleaning rod is comprised of three basic parts: a handle; a cleaning rod; and a cleaning tip. The typical cleaning tip comprises an arrangement wherein a piece of material, known in the art as a "patch", is secured to the tip. To clean a firearm, the cleaning tip (including patch) is inserted into the muzzle or breech end of a gun barrel. The patch is then moved back and forth so as to clean the barrel.

A recurring problem with prior art devices is that as the cleaning tip is withdrawn from the chamber end of the gun barrel, the patch has a tendency to become removed therefrom. This requires not only that a new patch be attached to the cleaning tip, but also requires that the removed patch be retrieved from the gun barrel. Thus, excess time and effort is required to complete the task. Moreover, the conventional cleaning patch often is repeatedly drawn through the barrel, causing dirt and fouling substances to be scrubbed back and forth in the bore.

SUMMARY OF THE INVENTION

The present invention solves the above-described problem in the prior art by providing a gun cleaning implement and swab that permits repeated insertion and withdrawal of a cleaning tip without the swab being removed from the gun cleaning implement.

Generally described, the gun cleaning implement of the present invention comprises a cleaning tip, a swab, and means for fixably securing the swab to the cleaning tip.

Described somewhat more particularly, the cleaning tip is formed having a first end thereof suitable for attachment to a conventional cleaning rod, and a second end remote of the first end, the second end being formed having a threaded portion which retainably receives the swab.

Thus, it is an object of the present invention to provide an improved gun cleaning implement.

It is a further object of the present invention to provide a gun cleaning implement having a novel cooperating cleaning tip and swab.

It is a further object of the present invention to provide a gun cleaning implement that prevents undesired removal of the swab from the cleaning tip while cleaning a gun.

It is yet another object of the present invention to provide a gun cleaning implement capable of cleaning firearms having various bore diameters with a cleaning rod of one size.

It is a still further object of the present invention to reduce the time and effort expended in cleaning a firearm.

Other objects, features and advantages of the present invention will become apparent from reading the following specification when taken in conjunction with the accompanying drawings.

BRIEF DESCRIPTION OF THE DRAWINGS

FIG. 1 is a pictorial view of the gun cleaning implement according to a preferred embodiment of the present invention, showing a gun cleaning rod separated from the cleaning tip and two swabs.

FIG. 2 is a front plan view of the cleaning tip of the embodiment shown in FIG. 1.

FIG. 3 is a cross-section view of the cleaning tip shown in FIG. 1, with the two swabs shown in place on the cleaning tip.

FIG. 4 is a pictorial view of the gun cleaning implement according to disclosed embodiment, showing the implement ready to receive cleaning swabs.

FIG. 5 is a pictorial view showing an alternative swab and claning implement for cleaning the chamber of a gun, according to the present invention.

DETAILED DESCRIPTION

Referring now in detail to the drawing, in which like numerals indicate like parts throughout the several views, FIG. 1 shows a conventional gun cleaning apparatus consisting of a handle member 12 and a cleaning rod 13. The end of the cleaning rod 13 furthest from the handle 12 comprises a threaded extension 14. As described in detail herein, the threaded extension 14 is formed so as to receive a cleaning tip 20 according to the present invention. It will be understood that intermediate cleaning rod sections (not shown) may be inserted between the cleaning rod 13 and the cleaning tip 20 so as to form an elongated unit that would typically be used to clean a rifle or similar firearm. The details of such are well known in the art and hence, need not be disclosed further herein.

The cleaning tip 20 is cylindrical in shape, and dimensioned so as to fit freely within the bore of the smallest calibre firearm for which use of the particular cleaning tip is contemplated. The preferred cleaning tip 20 is formed of any suitable rigid material. Suitable materials include steel, stainless steel, brass, aluminum, and copper.

It will be appreciated by one skilled in the art that the cleaning tip 20 is secured to the cleaning rod 13 by means of threaded extension 14. The tip 20 has an attachment end section 21 by which the tip is removably attached to the threaded extension 14 of the cleaning rod 13 (best shown in FIG. 4). To facilitate this attachment, the attachment end section 21 has an internal threaded bore 22. The internal threaded bore 22 is designed to receive the cooperating threaded extension 14 of the cleaning rod 13. As shown in FIG. 2, the attachment end section of the tip 20 also comprises an externally threaded outer surface 23. The threaded outer surface 23 is configured so as to be removably attachable to internally threaded extensions (not shown) of other conventional cleaning rods. Thus, it will be further appreciated that a tip 20 according to the present invention is suitable for use with conventional gun cleaning rods having various diameters and kinds of threads, male or female.

The tip 20 is further comprised of a second section 24 which is immediately adjacent to the attachment end section 21. This second section 24 includes a smooth outer circumference having a diameter of greater dimension than any other section of the tip. The smooth outer circumference of the section 24 provides a user of the present invention with a portion by which to hold the tip 20 within his or her fingertips. It will be appreciated, therefore, that the section 24 of the preferred tip 20 includes a smooth or knurled region of sufficient diameter to permit a user simple and quick manipulation of the implement.

The remaining portion of the tip 20 is remote from the attachment end section 21 and is comprised of two sections 25 and 26. The first remote end section 25 is located adjacent to the smooth section 24 and is formed having a reduced diameter relative thereto. The second remote end section 26 of the tip 20 is formed having a yet further reduced diameter relative to said first remote end section 25. As shown in FIG. 2, the first remote end section 25 has threads formed on the exterior thereof. These threads are preferably formed having a relatively coarse pitch. The second remote end section 26 is unthreaded, and thus comprises a nipple extension having a relatively smooth circumferential surface.

The disclosed embodiment further comprises swabs such as the swabs 30 and 31. The preferred swabs for cleaning a bore are substantially cylindrical in shape and have an axial internal passage 31 also of cylindrical shape. The swabs 30 and 31 preferably are made of a liquid absorbent, relatively lint-free material such as felt or the like, so as to prevent the deposit of any lint or any other such material into the barrel of the firearm. The internal diameter of the passage 32 of each swab is slightly smaller than the diameter of the first either remote end section 25 or 26 of the tip 20. Thus, it is to be appreciated that the swab 30 will fit snugly over the first remote end section 25, which preferably is screwed into the relatively soft swab material surrounding and forming the passage 31 so as to hold the swab in place on the tip 20. The external diameter of the swab 30 is determined by the calibre or bore diameter of the particular firearm to be cleaned. Thus it is within the scope of the present invention to provide a plurality of swabs having various external diameters to clean gun bores of various sizes, yet each swab is formed having substantially identical diameter of the internal passage 31.

The second swab 31 may be identical in size and construction to the first swab 30, and the second swab is placed over the second remote end section 26 of the tip 20 as shown in FIG. 3. The diameter of the smooth second end section 26 is slightly greater than that of the internal diameter of the passage 32 through the second swab 31, so that the second swab is friction-fitted onto the second end section.

The present gun cleaning implement is used in the following manner. The tip 20 is affixed to the end of the gun cleaning rod 13 as shown in FIG. 5, and the swabs 30 and 31 are placed on the tip as described above. A quantity of gun lubricating oil or solvent may be applied to the swab 30, or to both swabs 30 and 31. The tip 20 with swabs attached is now ready to be passed through the barrel of a gun, using the gun cleaning rod in the conventional manner described above.

The two swab arrangement is first introduced into the muzzle end of a gun barrel in the conventional manner and moved toward the chamber end of the gun. A preferred way of using the present gun cleaning implement calls for making a first pass through the gun bore with both swabs 30 and 31 in place as described. The swab 31, the first swab to engage the bore during this first pass through the bore, receives most of the dirt in the bore and this swab can easily be removed from the end section 26 after the first pass. The swab 30 remains in place on the tip 20 for second and subsequent passes through the bore, the external threads of the second end section 25 keeping the swab 30 on the tip as the cleaning rod 13 is withdrawn through the bore. This remaining swab 30 is relatively clean and remains effective for the second and subsequent passes. Moreover, a fresh swab 31 can be placed on the end section 26 before subsequent strokes, for further cleaning or oiling the bore. This is quicker and more effective than changing conventional cleaning patches with a cleaning rod tip of the prior art.

By using two swabs 30 and 31 at a time, a solvent for cleaning the bore can be applied to the leading swab 31, and oil or preservative can be applied to the trailing swab 30. The bore thus can be cleaned and lubricated at the same time with one pass, using the present cleaning implement.

It should now be apparent that guns of all calibers, including small-bore guns and shotguns, can be cleaned with the present cleaning implement. Only the size of the swabs need be changed to obtain the proper contact with the bore of a particular gun. Furthermore, the cylindrical swabs of the present invention are concentric with the bore and exert equal cleaning pressure on the entire surface of the bore, a result not obtained with conventional round or square cleaning patches and the conventional cleaning rod tip. The present cylindrical swabs are much easier to enter the small mouth of the solvent bottle for applying a controlled amount of solvent. In contrast, conventional gun cleaning patches typically absorb too much solvent, causing a mess when starting the patch in the bore and wasting solvent.

Swabs made of different material or having a different overall shape also are contemplated. For example, swabs can be provided with grit, wire, or molded bristles for difficult cleaning applications. FIG. 5 shows an example of swab 35 having a different overall shape, for cleaning the chamber of a gun. The chamber swab 35 is approximately twice the length of each individual swab 30, 31, and the chamber swab has an internal passage 36 which fits over both end sections 25 and 26 of the tip 20. In use, the tip 20' with the chamber swab attached is revolved with one's fingers, and for that purpose the central section 24' of the tip should be knurled for effective finger gripping.

Thus, it is seen that an apparatus embodying the present invention enjoys the particular advantage over prior art devices of fixably retaining the cleaning swab on the cleaning tip and comprises a novel apparatus which provides increased efficiency and reduced time spent in cleaning a gun.

While this invention has been described in detail with particular reference to preferred embodiments thereof, it will be understood that variations and modifications can be effected within the spirit and scope of the invention as described hereinbefore and as defined in the appended claims.

I claim:

1. A gun cleaning implement comprising:

a cylindrical cleaning tip, said cleaning tip comprising an end section operative for threaded attachment to a conventional gun cleaning rod, an intermediate section having a circumferential surface, a first section remote from said end section and of reduced diameter relative to said intermediate section and formed having a threaded surface, and a second section yet further remote from said end section and of reduced diameter relative to said first remote section; and cleaning means secured about said first section and said second section, said cleaning means including a first cylindrical cleaning swab having an internal passageway about its longitudinal axis, said passageway an internal diameter slightly smaller than that of said first section remote of said end section whereby said first swab is threadably fitted on the first section so as to prevent removal of said cleaning swab from said cleaning tip, and a second cylindrical cleaning swab having an internal passageway about its longitudinal axis, said passageway having an internal diameter slightly larger relative to that of said second section remote from said end section whereby said second swab freely fits about said second section and is slidably removable therefrom by withdrawing the cleaning tip from the barrel of a gun.

2. A gun cleaning implement comprising:

an extension member comprising an end section suitable for attachment to a conventional gun cleaning rod, an intermediate section having a circumferential surface, a first section remote from said end section having a threaded surface, and a second section remote from said end section of reduced diameter relative to said first section;

a first cylindrical swab having an integral passage for threaded engagement on said threaded surface, so as to be retained on said extension member; and a second cylindrical swab having an internal passage for fitting on said second section of said extension member, said second section having an exterior surface which receives and supports said internal passage of said second swab without retaining the second swab thereon, so that the second swab is readily removable from the extension member without unthreading the first swab.

3. A gun cleaning implement comprising:

a cylindrical cleaning tip comprising an end section operative for threaded attachment to a conventional gun cleaning rod, an intermediate section having a circumferential surface, a first section remote from said end section of reduced diameter relative to said intermediate section and having a threaded surface, and a second section yet further remote from said end section of reduced diameter relative to said first remote section; and a cylindrical cleaning swab long enough to fit over both said first section and said second section of said cleaning tip, said cleaning swab having an internal passageway about its longitudinal axis, said passageway having an internal diameter slightly smaller than that of said first section remote from said end section whereby said swab is threadably fitted thereabout so as to prevent removal of said cleaning swab from said cleaning tip, and the external diameter of said cleaning swab surrounding said first section of the cleaning tip being greater than the external diameter of said cleaning swab surrounding said second section of the cleaning tip.

4. An implement as in claim 3, wherein:

said circumferential surface is roughened to provide a good finger gripping surface, so that the implement may be manually manipulated to clean the chamber of a gun or the like.

* * * * *